US005518135A

United States Patent [19]

Freund

[11] Patent Number: 5,518,135

[45] Date of Patent: May 21, 1996

[54] ROLL-RESISTANT TENNIS BALL CAN AND LID

[76] Inventor: William D. Freund, 232 N. Kingshighway, Apartment 2200, St. Louis, Mo. 63108

[21] Appl. No.: 264,202

[22] Filed: Jun. 22, 1994

[51] Int. Cl.[6] ..... B65D 43/06; B65D 43/08

[52] U.S. Cl. ..... 220/356; 215/329; 220/352; 220/630; 220/DIG. 13

[58] Field of Search ..... 215/1 R, 200, 215/100 R, 100.5, 305, 329, 331; 220/200, 258, 352, 356, 357, DIG. 13, 630; 206/315.9, 535, 806; 229/1.5 H, 115

[56] References Cited

U.S. PATENT DOCUMENTS

| | | | |
|---|---|---|---|
| 2,606,708 | 8/1952 | Irvan . | |
| 2,754,962 | 7/1956 | Scrymgeour . | |
| 2,972,407 | 2/1961 | Taylor | 229/101.1 X |
| 2,990,998 | 7/1961 | Barclay . | |
| 3,350,131 | 10/1967 | Tanzer | 215/100.5 X |
| 3,897,874 | 8/1975 | Coons | 206/315.9 |
| 4,151,910 | 5/1979 | Yasur | 206/216 |
| 4,232,785 | 11/1980 | Lucas | 206/228 |
| 4,295,680 | 10/1981 | Grasso | 297/193 |
| 4,483,455 | 11/1984 | Prophet, Jr. et al. | 220/23.83 |
| 4,858,777 | 8/1989 | Morel | 215/295 |
| 4,990,345 | 2/1991 | Webb | 220/256 |
| 5,295,598 | 3/1994 | Gerlach et al. | 215/100 R |

FOREIGN PATENT DOCUMENTS

| | | | |
|---|---|---|---|
| 10837 | of 1893 | United Kingdom | 206/391 |

*Primary Examiner*—Gary E. Elkins
*Attorney, Agent, or Firm*—Kenyon & Kenyon

[57] ABSTRACT

A roll-resistant tennis ball can and lid are provided with features that prevent cans from rolling on flat surfaces. The cans and lids may be manufactured in an economically efficient way. The invention can be accomplished in two ways. The first is by providing the can's lid with a square or other configuration such that a non-circular edge contacts the ground. The second way is to have the body portion of the can have a square cross-section or some other cross-section that is configured to prevent rolling.

1 Claim, 5 Drawing Sheets

ROLL-RESISTANT TENNIS BALL CAN AND LID

BACKGROUND OF THE INVENTION

Tennis ball cans are usually cylindrical cans made of metal or plastic with a removable lid to typically hold three tennis balls. The problem with these cans is that when they are used on a tennis court, and particularly when the balls have been removed for play, they tend to roll around the court to the distraction of the players and everyone else. Heretofore, there has been no reasonable method to prevent this rolling other than placing the can in a bag or placing it in some other location. There is a need for a can which can hold tennis balls but is prevented from rolling.

SUMMARY OF THE INVENTION

The invention described herein has arrived at an economically efficient way for preventing cans from rolling and avoiding the above-mentioned disconcerting effects, particularly during play. This can be accomplished in two ways. The first is by providing the can's lid with a square or other orthogonal configuration such that a flat edge contacts the ground. The second way is to have the body portion of the can have a square cross-section or some other non-circular cross-section. Alternatively, the cross-section may have the shape of a gear wheel or a cog.

Either of these ways provides a tennis ball can and/or lid with a cross-section, taken perpendicular to the axis containing the centers of the balls, that is asymmetric with respect to rotations about the above-mentioned axis. In the first, the cross-section spoken of is of the lid; in the second, the cross-section spoken of is of the can. In either case, the cross-section is configured to prevent rolling.

BRIEF DESCRIPTION OF THE PREFERRED EMBODIMENTS

Figure 1:
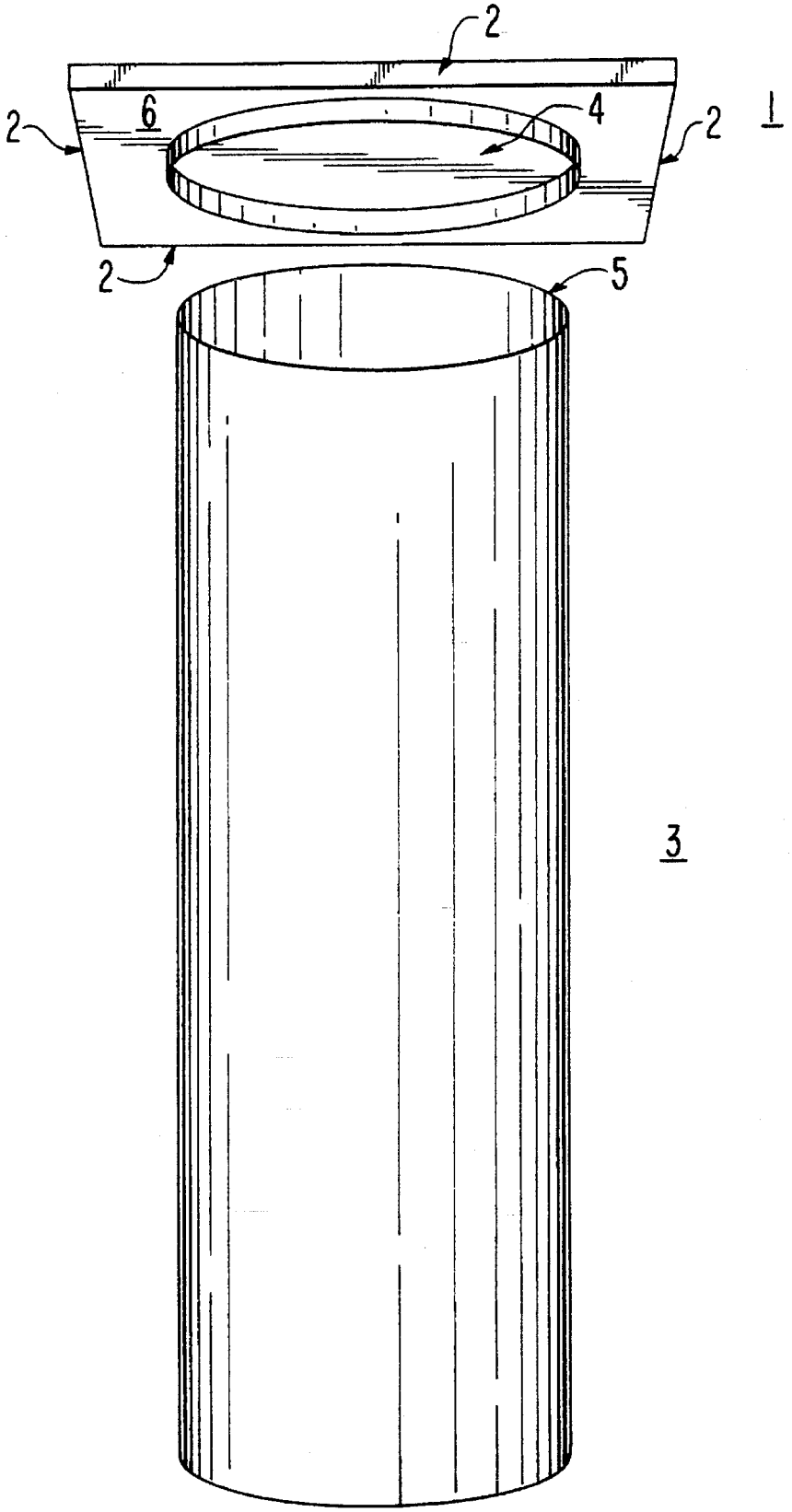
FIG. 1 is a perspective view of a tennis ball can shown in an exploded view with a cylindrical can and a square lid according to an embodiment of the present invention.

As can be seen in connection with FIG. 1, there is a tennis ball can 3 which is generally cylindrical in configuration having a circular cross section. The can has a diameter and length to accommodate three tennis balls, as is typical. The top 5 of the can 3 is covered with a metal peel-away section (not shown) which permits the balls to be maintained under pressure. A plastic lid 1 is included which has a square piece 6 having four sides 2, each having a planar surface. An inner lip 4 of the lid 1 is circular and has a diameter appropriate to friction-fit over the top 5 of the can 3.

As is well known in the art, once the metal peel-away portion (not shown) is removed, the can is decompressed and the balls can be removed for play. In this particular embodiment, the lid 1 with the four planar surfaces 2 would be replaced on the can such that the can, when on its side, would not roll across the court. The can's roll-resistance would contrast with the roll-propensity of cans of the prior art.

It is important to note that, while a square lid 1 has been described, any lid that has a circumferential side edge that prevents rolling could be used. In particular, any lid whose shape, when viewed from the top, is not symmetric with respect to rotations would be appropriate. For example, a lid having the shape of a gear wheel or a cog could be used. That is, the contour of the lid, viewed in a plane perpendicular to the axis joining the centers of the balls, must be asymmetric with respect to rotations.

Figure 2:
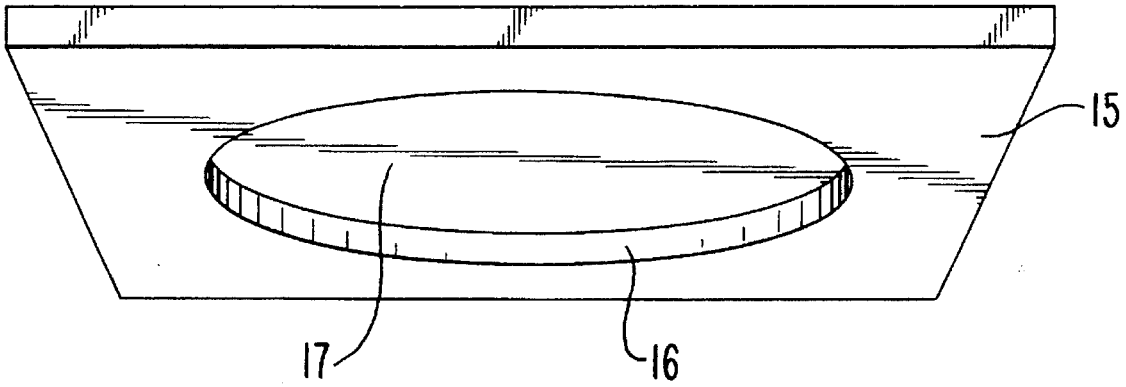
FIG. 2 is a perspective view of an embodiment of the invention showing a lid composed of a solid block of plastic with a recess.
Figure 4:
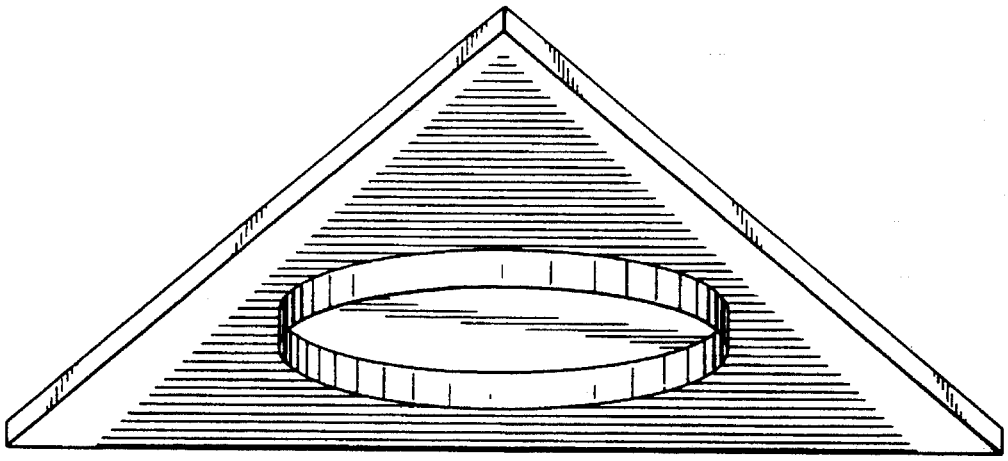
FIG. 4 is a perspective view of a triangular-shaped lid according to an embodiment of the present invention.

In another embodiment of the invention, as shown in FIG. 2, the lid is composed of a solid block of plastic 15 with a recess defined by recess wall 16 and recess top 17. The recess is advantageously circular, so as to fit on the top of a prior art tennis ball can. However, the recess may be any shape, as long as the top of the can has a corresponding shape so as to allow a friction fit between the lid and the can.

Figure 3:
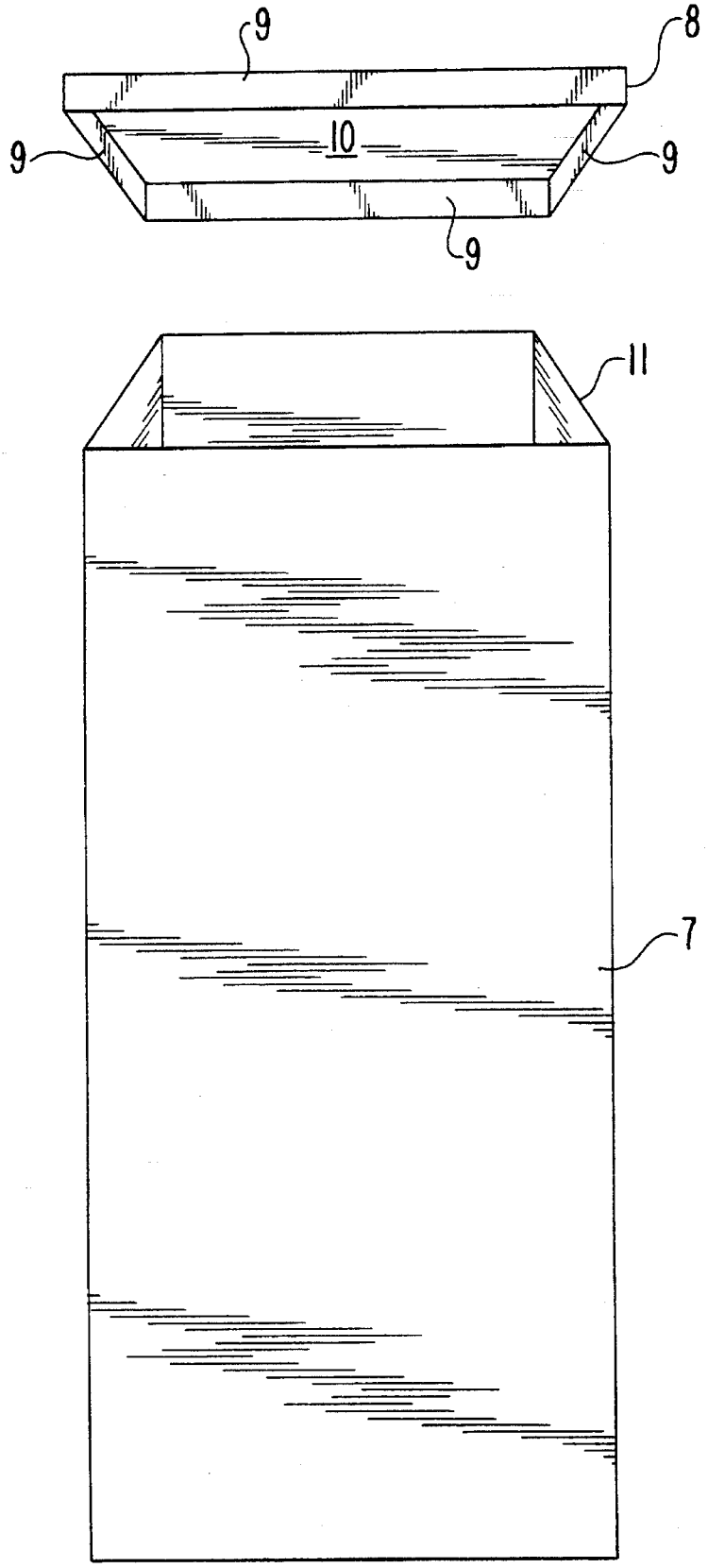
FIG. 3 is an exploded view of another embodiment of a tennis ball can, where the can itself has a non-circular cross section.
Figure 5:
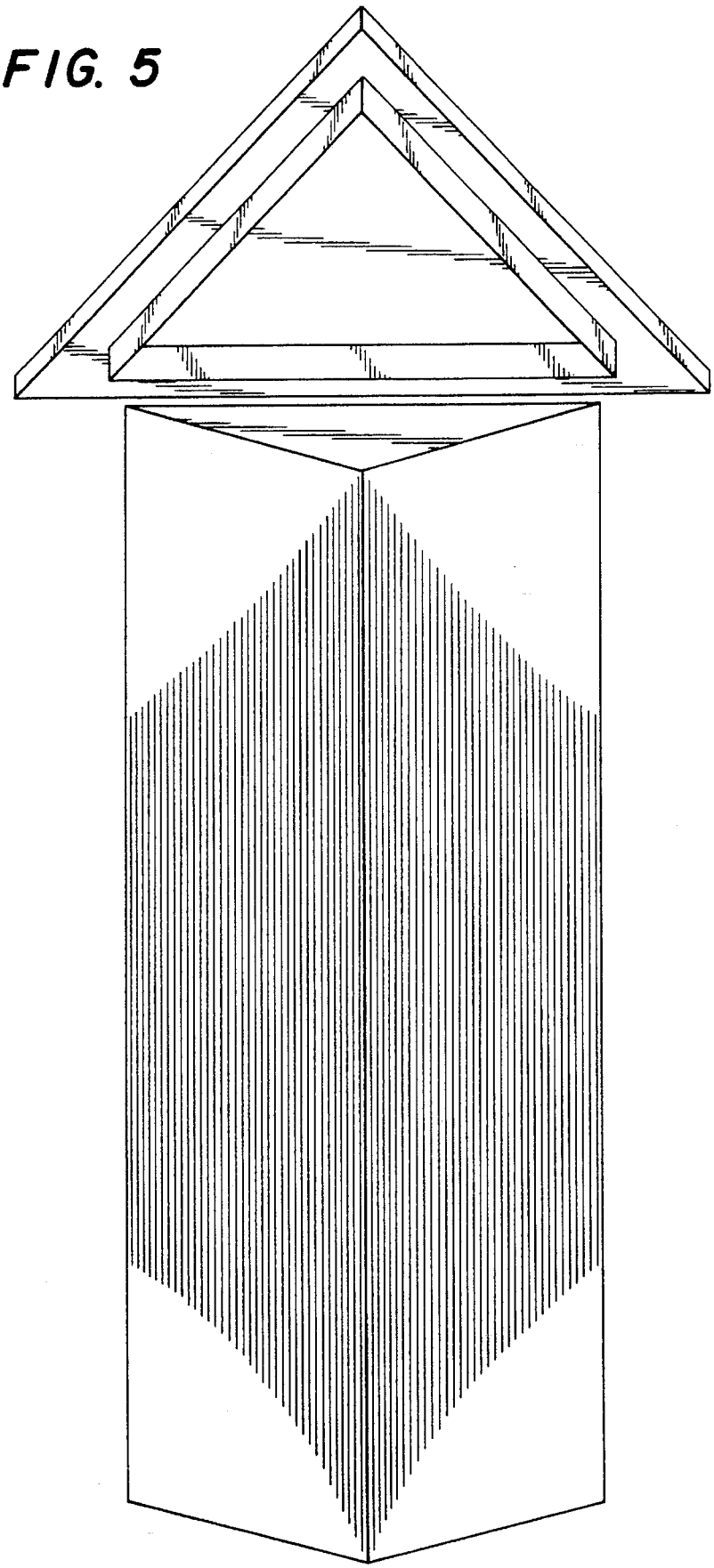
FIG. 5 is a perspective view of a triangular-shaped lid and container according to an embodiment of the present invention.
Figure 6:
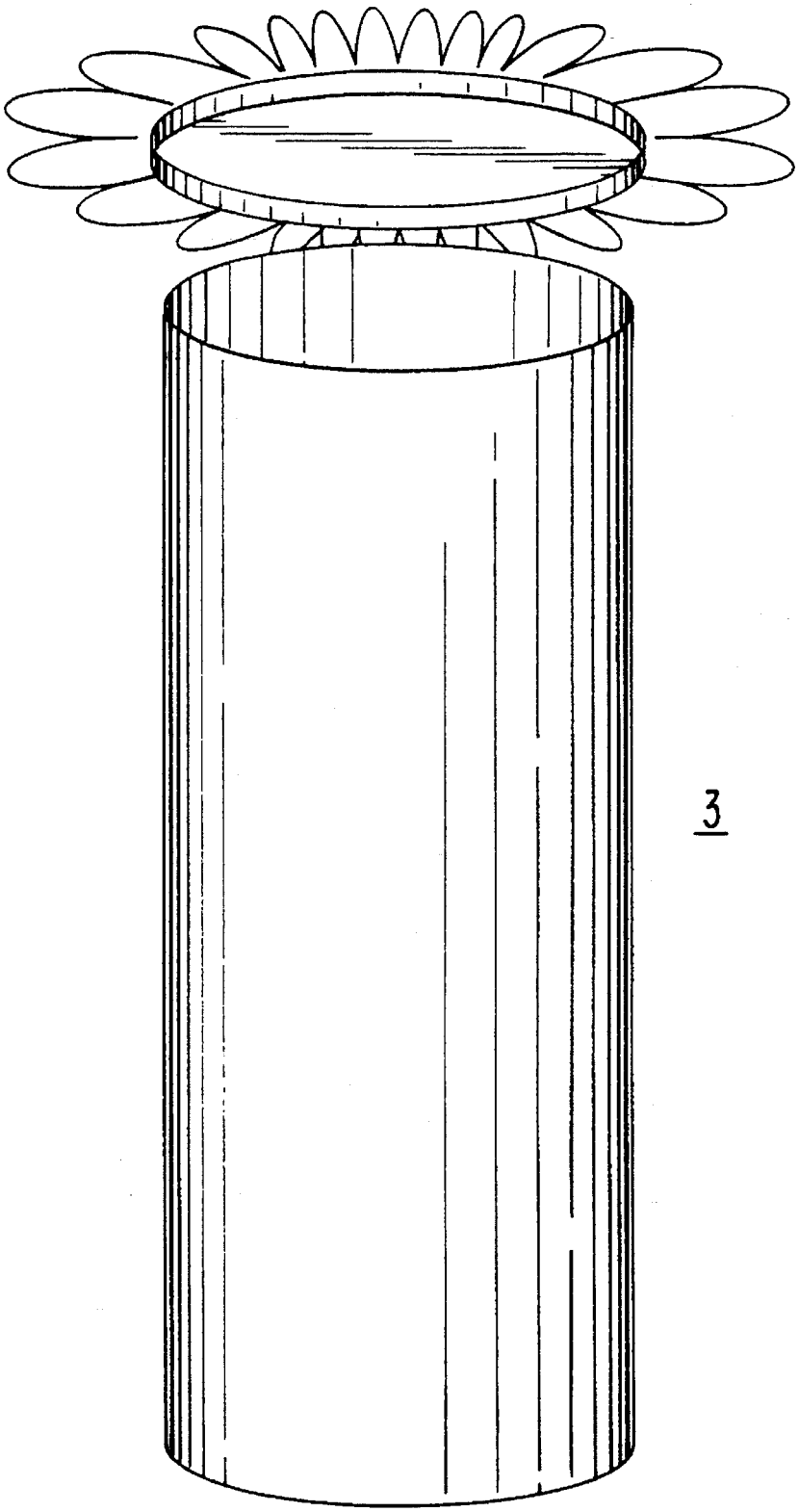
FIG. 6 is a perspective view of a gear-wheel shaped lid according to an embodiment of the present invention.

FIG. 3 shows another embodiment of the present invention. Rather than the can having a circular cross section, it is non-circular. In this way, when the can is laying on its side, it is prevented from rolling. For example, the can 7 may have a square, triangular, or rectangular cross-section. Alternatively, the can may have the shape of a gear wheel or a cog. In FIG. 3, the square embodiment is shown. However, with this configuration, the can may have, for example, a square cover or even, as utilized in the prior art, a round cover.

The length and width dimensions of the can are sufficient to hold three tennis balls in stacked relationship as shown. In this case, the width dimension is slightly larger than the diameter of a tennis ball, as is the length dimension. In this particular embodiment, the top 11 is square with a metal peel-away portion (not shown) with a tab extending from the metal peel-away portion (not shown) to assist the removal of the peel-away portion from the top 11 of the can 7. The lid 8, as shown here, is square. However, in the embodiment, either square or circular lids may be accommodated. Of course, the lip 9 of the lid 8 must be such that it can cooperate with the top 11 of the can 7. Here, both the external and internal edge surfaces are shown square and are made to friction-fit over the square opening of the can. With tennis ball cans of this type, the can may be placed on a surface adjacent to a tennis court or other flat surface without fear of the can rolling around the court and affecting the play.

It is also important to note that, while a square can 7 has been described, any can that has a circumferential cross-sectional edge would work. In particular, any can whose shape, when viewed from the top, without the lid on, is not symmetric with respect to rotations would be appropriate. That is, the contour of the can, viewed in a plane perpendicular to the axis joining the centers of the balls, must not have circular symmetry.

It should be understood that the above has been a detailed description of the preferred embodiments. The full scope of the invention is covered only by the claims which follow and any equivalents thereof.

What is claimed is:

1. A lid for tennis ball cans, comprising a substantially planar piece, said planar piece having two planar faces, said lid having a shape with a circumferential edge that is configured to prevent rolling, said planar piece having a cylindrical recess on one of said planar faces, for friction-fitting over a top of a tennis ball can.

* * * * *